US008887810B2

(12) United States Patent
Parsche

(10) Patent No.: US 8,887,810 B2
(45) Date of Patent: Nov. 18, 2014

(54) IN SITU LOOP ANTENNA ARRAYS FOR SUBSURFACE HYDROCARBON HEATING

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 507 days.

(21) Appl. No.: 12/396,247

(22) Filed: Mar. 2, 2009

(65) Prior Publication Data

US 2010/0218940 A1 Sep. 2, 2010

(51) Int. Cl.
*E21B 43/24* (2006.01)
*E21B 36/04* (2006.01)

(52) U.S. Cl.
CPC ..... *E21B 43/2401* (2013.01)
USPC ..... 166/302; 166/248; 166/60

(58) Field of Classification Search
CPC ..... E21B 36/04; E21B 43/2401
USPC ..... 166/248, 302, 60
See application file for complete search history.

(56) References Cited

U.S. PATENT DOCUMENTS

| | | | | |
|---|---|---|---|---|
| 2,371,459 | A | 3/1945 | Mittelmann | |
| 2,685,930 | A | 8/1954 | Albaugh | |
| 3,497,005 | A | 2/1970 | Pelopsky | |
| 3,848,671 | A * | 11/1974 | Kern | 166/248 |
| 3,954,140 | A | 5/1976 | Hendrick | |
| 3,988,036 | A | 10/1976 | Fisher | |
| 3,991,091 | A | 11/1976 | Driscoll | |
| 4,035,282 | A | 7/1977 | Stuchberry et al. | |
| 4,042,487 | A | 8/1977 | Seguchi | |
| 4,087,781 | A | 5/1978 | Grossi et al. | |
| 4,136,014 | A | 1/1979 | Vermeulen | |
| 4,140,179 | A | 2/1979 | Kasevich et al. | |
| 4,140,180 | A | 2/1979 | Bridges et al. | |
| 4,144,935 | A | 3/1979 | Bridges et al. | |
| 4,146,125 | A | 3/1979 | Sanford et al. | |
| 4,196,329 | A | 4/1980 | Rowland et al. | |
| 4,295,880 | A | 10/1981 | Horner | |
| 4,300,219 | A | 11/1981 | Joyal | |
| 4,301,865 | A | 11/1981 | Kasevich et al. | |
| 4,328,324 | A | 5/1982 | Kock | |
| 4,373,581 | A | 2/1983 | Toellner | |
| 4,396,062 | A | 8/1983 | Iskander | |

(Continued)

FOREIGN PATENT DOCUMENTS

| | | |
|---|---|---|
| CA | 1199573 A1 | 1/1986 |
| CA | 2678473 | 8/2009 |

(Continued)

OTHER PUBLICATIONS

Carlson et al., "Development of the I IT Research Institute RF Heating Process for In Situ Oil Shale/Tar Sand Fuel Extraction—An Overview", Apr. 1981.

(Continued)

*Primary Examiner* — David Andrews
(74) *Attorney, Agent, or Firm* — Allen, Dyer, Doppelt, Milbrath, Gilchrist, P.A.

(57) ABSTRACT

An array of loop antennas for a heating subsurface formation by emission of RF energy and a method of heating a subsurface formation by an array of subsurface loop antennas is disclosed. The antennas are approximate loops and are positioned in proximity to adjacent loops. The antennas are driven by RF energy.

10 Claims, 6 Drawing Sheets

(56) References Cited

U.S. PATENT DOCUMENTS

| | | | | |
|---|---|---|---|---|
| 4,404,123 | A | 9/1983 | Chu | |
| 4,410,216 | A | 10/1983 | Allen | |
| 4,425,227 | A | 1/1984 | Smith | |
| 4,449,585 | A * | 5/1984 | Bridges et al. | 166/248 |
| 4,456,065 | A | 6/1984 | Heim | |
| 4,457,365 | A | 7/1984 | Kasevich et al. | |
| 4,470,459 | A | 9/1984 | Copland | |
| 4,485,869 | A | 12/1984 | Sresty | |
| 4,487,257 | A | 12/1984 | Dauphine | |
| 4,508,168 | A | 4/1985 | Heeren | |
| 4,514,305 | A | 4/1985 | Filby | |
| 4,524,827 | A | 6/1985 | Bridges | |
| 4,531,468 | A | 7/1985 | Simon | |
| 4,583,586 | A | 4/1986 | Fujimoto et al. | |
| 4,620,593 | A | 11/1986 | Haagensen | |
| 4,622,496 | A | 11/1986 | Dattili | |
| 4,645,585 | A | 2/1987 | White | |
| 4,678,034 | A | 7/1987 | Eastlund | |
| 4,703,433 | A | 10/1987 | Sharrit | |
| 4,790,375 | A | 12/1988 | Bridges | |
| 4,817,711 | A | 4/1989 | Jeambey | |
| 4,882,984 | A | 11/1989 | Eves, II | |
| 4,892,782 | A | 1/1990 | Fisher et al. | |
| 5,046,559 | A | 9/1991 | Glandt | |
| 5,055,180 | A | 10/1991 | Klaila | |
| 5,065,819 | A | 11/1991 | Kasevich | |
| 5,082,054 | A | 1/1992 | Kiamanesh | |
| 5,136,249 | A | 8/1992 | White | |
| 5,199,488 | A | 4/1993 | Kasevich | |
| 5,233,306 | A | 8/1993 | Misra | |
| 5,236,039 | A | 8/1993 | Edelstein | |
| 5,251,700 | A | 10/1993 | Nelson | |
| 5,293,936 | A | 3/1994 | Bridges | |
| 5,304,767 | A | 4/1994 | McGaffigan | |
| 5,315,561 | A | 5/1994 | Grossi | |
| 5,370,477 | A | 12/1994 | Bunin | |
| 5,378,879 | A | 1/1995 | Monovoukas | |
| 5,506,592 | A | 4/1996 | MacDonald | |
| 5,582,854 | A | 12/1996 | Nosaka | |
| 5,621,844 | A | 4/1997 | Bridges | |
| 5,631,562 | A | 5/1997 | Cram | |
| 5,746,909 | A | 5/1998 | Calta | |
| 5,910,287 | A | 6/1999 | Cassin | |
| 5,923,299 | A | 7/1999 | Brown et al. | |
| 6,045,648 | A | 4/2000 | Palmgren et al. | |
| 6,046,464 | A | 4/2000 | Schetzina | |
| 6,055,213 | A | 4/2000 | Rubbo | |
| 6,063,338 | A | 5/2000 | Pham | |
| 6,097,262 | A | 8/2000 | Combellack | |
| 6,106,895 | A | 8/2000 | Usuki | |
| 6,112,273 | A | 8/2000 | Kau | |
| 6,184,427 | B1 | 2/2001 | Klepfer | |
| 6,229,603 | B1 | 5/2001 | Coassin | |
| 6,232,114 | B1 | 5/2001 | Coassin | |
| 6,301,088 | B1 | 10/2001 | Nakada | |
| 6,303,021 | B2 | 10/2001 | Winter et al. | |
| 6,348,679 | B1 | 2/2002 | Ryan et al. | |
| 6,360,819 | B1 | 3/2002 | Vinegar | |
| 6,432,365 | B1 | 8/2002 | Levin | |
| 6,603,309 | B2 | 8/2003 | Forgang | |
| 6,613,678 | B1 | 9/2003 | Sakaguchi | |
| 6,614,059 | B1 | 9/2003 | Tsujimura | |
| 6,649,888 | B2 | 11/2003 | Ryan et al. | |
| 6,712,136 | B2 | 3/2004 | de Rouffignac | |
| 6,808,935 | B2 | 10/2004 | Levin | |
| 6,923,273 | B2 | 8/2005 | Terry | |
| 6,932,155 | B2 | 8/2005 | Vinegar | |
| 6,967,589 | B1 | 11/2005 | Peters | |
| 6,992,630 | B2 | 1/2006 | Parsche | |
| 7,046,584 | B2 | 5/2006 | Sorrells | |
| 7,079,081 | B2 | 7/2006 | Parsche et al. | |
| 7,091,460 | B2 | 8/2006 | Kinzer | |
| 7,109,457 | B2 | 9/2006 | Kinzer | |
| 7,115,847 | B2 | 10/2006 | Kinzer | |
| 7,147,057 | B2 | 12/2006 | Steele | |
| 7,172,038 | B2 | 2/2007 | Terry | |
| 7,205,947 | B2 | 4/2007 | Parsche | |
| 7,312,428 | B2 | 12/2007 | Kinzer | |
| 7,322,416 | B2 | 1/2008 | Burris, II | |
| 7,337,980 | B2 | 3/2008 | Schaedel | |
| 7,438,807 | B2 | 10/2008 | Garner et al. | |
| 7,441,597 | B2 | 10/2008 | Kasevich | |
| 7,461,693 | B2 | 12/2008 | Considine et al. | |
| 7,484,561 | B2 | 2/2009 | Bridges | |
| 7,562,708 | B2 | 7/2009 | Cogliandro | |
| 7,623,804 | B2 | 11/2009 | Sone | |
| 2002/0032534 | A1 | 3/2002 | Regier | |
| 2004/0031731 | A1 | 2/2004 | Honeycutt | |
| 2005/0199386 | A1 | 9/2005 | Kinzer | |
| 2005/0274513 | A1 | 12/2005 | Schultz | |
| 2006/0038083 | A1 | 2/2006 | Criswell | |
| 2007/0108202 | A1 | 5/2007 | Kinzer | |
| 2007/0131591 | A1 | 6/2007 | Pringle | |
| 2007/0137852 | A1 | 6/2007 | Considine et al. | |
| 2007/0137858 | A1 | 6/2007 | Considine et al. | |
| 2007/0187089 | A1 | 8/2007 | Bridges | |
| 2007/0261844 | A1 | 11/2007 | Cogliandro et al. | |
| 2008/0073079 | A1 | 3/2008 | Tranquilla | |
| 2008/0143330 | A1 | 6/2008 | Madio | |
| 2009/0009410 | A1 | 1/2009 | Dolgin et al. | |
| 2009/0242196 | A1 | 10/2009 | Pao | |

FOREIGN PATENT DOCUMENTS

| | | | |
|---|---|---|---|
| DE | 10 2008 022176 | A1 | 11/2009 |
| EP | 0 135 966 | | 4/1985 |
| EP | 0418117 | A1 | 3/1991 |
| EP | 0563999 | A2 | 10/1993 |
| EP | 1106672 | A1 | 6/2001 |
| FR | 1586066 | A | 2/1970 |
| FR | 2925519 | A1 | 6/2009 |
| JP | 56050119 | A | 5/1981 |
| JP | 2246502 | A | 10/1990 |
| WO | WO 2007/133461 | | 11/2007 |
| WO | 2008/011412 | A2 | 1/2008 |
| WO | WO 2008/030337 | | 3/2008 |
| WO | WO2008098850 | A1 | 8/2008 |
| WO | WO2009027262 | A1 | 8/2008 |
| WO | WO2009/114934 | A1 | 9/2009 |

OTHER PUBLICATIONS

"Oil sands." Wikipedia, the free encyclopedia. Retrieved from the Internet from: http://en.wikipedia.org/w/index.php?title=Oil_sands&printable=yes, Feb. 16, 2009.

Sahni et al., "Electromagnetic Heating Methods for Heavy Oil Reservoirs." 2000 Society of Petroleum Engineers SPE/AAPG Western Regional Meeting, Jun. 19-23, 2000.

Power et al., "Froth Treatment: Past, Present & Future." Oil Sands Symposium, University of Alberta, May 3-5, 2004.

Flint, "Bitumen Recovery Technology a Review of Long Term R&D Opportunities." Jan. 31, 2005. Lenef Consulting (1994) Limited.

"Froth Flotation." Wikipedia, the free encyclopedia. Retrieved from the internet from: http://en.wikipedia.org/wiki/Froth_flotation, Apr. 7, 2009.

"Relative static permittivity." Wikipedia, the free encyclopedia. Retrieved from the Internet from http://en.wikipedia.org/w/index/php?title=Relative_static_permittivity&printable=yes, Feb. 12, 2009.

"Tailings." Wikipedia, the free encyclopedia. Retrieved from the Internet from http://en.wikipedia.org/w/index.php?title=Tailings&printable=yes, Feb. 12, 2009.

U.S. Appl. No. 12/886,338, filed Sep. 20, 2010 (unpublished).

Butler, R.M. "Theoretical Studies on the Gravity Drainage of Heavy Oil During In-Situ Steam Heating", Can J. Chem Eng, vol. 59, 1981.

Butler, R. and Mokrys, I., "A New Process (VAPEX) for Recovering Heavy Oils Using Hot Water and Hydrocarbon Vapour", Journal of Canadian Petroleum Technology, 30(1), 97-106, 1991.

Butler, R. and Mokrys, I., "Recovery of Heavy Oils Using Vapourized Hydrocarbon Solvents: Further Development of the VAPEX Process", Journal of Canadian Petroleum Technology, 32(6), 56-62, 1993.

(56) References Cited

OTHER PUBLICATIONS

Butler, R. and Mokrys, I., "Closed Loop Extraction Method for the Recovery of Heavy Oils and Bitumens Underlain by Aquifers: the VAPEX Process", Journal of Canadian Petroleum Technology, 37(4), 41-50, 1998.
Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995.
Das, S.K. and Butler, R.M., "Diffusion Coefficients of Propane and Butane in Peace River Bitumen" Canadian Journal of Chemical Engineering, 74, 988-989, Dec. 1996.
Das, S.K. and Butler, R.M., "Mechanism of the Vapour Extraction Process for Heavy Oil and Bitumen", Journal of Petroleum Science and Engineering, 21, 43-59, 1998.
Dunn, S.G., Nenniger, E. and Rajan, R., "A Study of Bitumen Recovery by Gravity Drainage Using Low Temperature Soluble Gas Injection", Canadian Journal of Chemical Engineering, 67, 978-991, Dec. 1989.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 17-24, 1998.
Mokrys, I., and Butler, R., "In Situ Upgrading of Heavy Oils and Bitumen by Propane Deasphalting: The VAPEX Process", SPE 25452, presented at the SPE Production Operations Symposium held in Oklahoma City OK USA, Mar. 21-23, 1993.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008.
Nenniger, J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta Canada, Jun. 16-18, 2009.
Bridges, J.E., Sresty, G.C., Spencer, H.L. and Wattenbarger, R.A., "Electromagnetic Stimulation of Heavy Oil Wells", 1221-1232, Third International Conference on Heavy Oil Crude and Tar Sands, UNITAR/UNDP, Long Beach California, USA Jul. 22-31, 1985.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008.
Carrizales, M. and Lake, L.W., "Two-Dimensional COMSOL Simulation of Heavy-Oil Recovery by Electromagnetic Heating", Proceedings of the COMSOL Conference Boston, 2009.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992.
Chhetri, A.B. and Islam, M.R., "A Critical Review of Electromagnetic Heating for Enhanced Oil Recovery", Petroleum Science and Technology, 26(14), 1619-1631, 2008.
Chute, F.S., Vermeulen, F.E., Cervenan, M.R. and McVea, F.J., "Electrical Properties of Athabasca Oil Sands", Canadian Journal of Earth Science, 16, 2009-2021, 1979.
Davidson, R.J., "Electromagnetic Stimulation of Lloydminster Heavy Oil Reservoirs", Journal of Canadian Petroleum Technology, 34(4), 15-24, 1995.
Hu, Y., Jha, K.N. and Chakma, A., "Heavy-Oil Recovery from Thin Pay Zones by Electromagnetic Heating", Energy Sources, 21(1-2), 63-73, 1999.
Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994.
Koolman, M., Huber, N., Diehl, D. and Wacker, B., "Electromagnetic Heating Method to Improve Steam Assisted Gravity Drainage", SPE117481, presented at the 2008 SPE International Thermal Operations and Heavy Oil Symposium held in Calgary, Alberta, Canada, Oct. 20-23, 2008.
Kovaleva, L.A., Nasyrov, N.M. and Khaidar, A.M., Mathematical Modelling of High-Frequency Electromagnetic Heating of the Bottom-Hole Area of Horizontal Oil Wells, Journal of Engineering Physics and Thermophysics, 77(6), 1184-1191, 2004.
McGee, B.C.W. and Donaldson, R.D., "Heat Transfer Fundamentals for Electro-thermal Heating of Oil Reservoirs", CIPC 2009-024, presented at the Canadian International Petroleum Conference, held in Calgary, Alberta, Canada Jun. 16-18, 2009.
Ovalles, C., Fonseca, A., Lara, A., Alvarado, V., Urrecheaga, K, Ranson, A. and Mendoza, H., "Opportunities of Downhole Dielectric Heating in Venezuela: Three Case Studies Involving Medium, Heavy and Extra-Heavy Crude Oil Reservoirs" SPE78980, presented at the 2002 SPE International Thermal Operations and Heavy Oil Symposium and International Horizontal Well Technology Conference held in Calgary, Alberta, Canada, Nov. 4-7, 2002.
Rice, S.A., Kok, A.L. and Neate, C.J., "A Test of the Electric Heating Process as a Means of Stimulating the Productivity of an Oil Well in the Schoonebeek Field", CIM 92-04 presented at the CIM 1992 Annual Technical Conference in Calgary, Jun. 7-10, 1992.
Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000.
Sayakhov, F.L., Kovaleva, L.A. and Nasyrov, N.M., "Special Features of Heat and Mass Exchange in the Face Zone of Boreholes upon Injection of a Solvent with a Simultaneous Electromagnetic Effect", Journal of Engineering Physics and Thermophysics, 71(1), 161-165, 1998.
Spencer, H.L., Bennett, K.A. and Bridges, J.E. "Application of the IITRI/Uentech Electromagnetic Stimulation Process to Canadian Heavy Oil Reservoirs" Paper 42, Fourth International Conference on Heavy Oil Crude and Tar Sands, UNITAR/UNDP, Edmonton, Alberta, Canada, Aug. 7-12, 1988.
Sresty, G.C., Dev, H., Snow, R.N. and Bridges, J.E., "Recovery of Bitumen from Tar Sand Deposits with the Radio Frequency Process", SPE Reservoir Engineering, 85-94, Jan. 1986.
Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 25-29, 2000.
Schelkunoff, S.K. and Friis, H.T., "Antennas: Theory and Practice", John Wiley & Sons, Inc., London, Chapman Hall, Limited, pp. 229-244, 351-353, 1952.
Gupta, S.C., Gittins, S.D., "Effect of Solvent Sequencing and Other Enhancement on Solvent Aided Process", Journal of Canadian Petroleum Technology, vol. 46, No. 9, pp. 57-61, Sep. 2007.
"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.
Burnhan, "Slow Radio-Frequency Processing of Large Oil Shale Volumes to Produce Petroleum-like Shale Oil," U.S. Department of Energy, Lawrence Livermore National Laboratory, Aug. 20, 2003, UCRL-ID-155045.
Sahni et al., "Electromagnetic Heating Methods for Heavy Oil Reservoirs," U.S. Department of Energy, Lawrence Livermore National Laboratory, May 1, 2000, UCL-JC-138802.
Abernethy, "Production Increase of Heavy Oils by Electromagnetic Heating," The Journal of Canadian Petroleum Technology, Jul.-Sep. 1976, pp. 91-97.
Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.

(56) References Cited

OTHER PUBLICATIONS

Kinzer, A Review of Notable Intellectual Property for in Situ Electromagnetic Heating of Oil Shale, Quasar Energy LLC.
PCT International Search Report and Written Opinion in PCT/US2010/025765, Jun. 30, 2010.
PCT International Search Report and Written Opinion in PCT/US2010/025772, Aug. 9, 2010.
PCT International Search Report and Written Opinion in PCT/US2010/025763, Jun. 4, 2010.
PCT International Search Report and Written Opinion in PCT/US2010/025807, Jun. 17, 2010.
PCT International Search Report and Written Opinion in PCT/US2010/025804, Jun. 30, 2010.
PCT International Search Report and Written Opinion in PCT/US2010/025769, Jun. 10, 2010.
A. Godio: "Open ended-coaxial Cable Measurements of Saturated Sandy Soils", American Journal of Environmental Sciences, vol. 3, No. 3, 2007, pp. 175-182, XP002583544.
United States Patent and Trademark Office, Non-final Office action issued in U.S. Appl. No. 12/396,284, dated Apr. 26, 2011.
Patent Cooperation Treaty, Notification of Transmittal of the International Search Report and The Written Opinion of the International Searching Authority, or the Declaration, in PCT/US2010/025808, dated Apr. 5, 2011.
Deutsch, C.V., McLennan, J.A., "The Steam Assisted Gravity Drainage (SAGD) Process," Guide to SAGD (Steam Assisted Gravity Drainage) Reservoir Characterization Using Geostatistics, Centre for Computational Statistics (CCG), Guidebook Series, 2005, vol. 3; p. 2, section 1.2, published by Centre for Computational Statistics, Edmonton, AB, Canada.
Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of The Institution of Electrical Engineers, © 1986.
Marcuvitz, Nathan, Waveguide Handbook; 1986; Institution of Engineering and Technology, vol. 21 of IEE Electromagnetic Wave series, ISBN 0863410588, Chapter 2.3, pp. 66-72, published by Peter Peregrinus Ltd. on behalf of The Institution of Electrical Engineers, © 1986.
PCT Notification of Transmittal of the International Search Report and The Written Opinion of the International Searching Authority, or the Declaration, in PCT/US2010/025761, dated Feb. 9, 2011.
PCT Notification of Transmittal of the International Search Report and The Written Opinion of the International Searching Authority, or the Declaration, in PCT/US2010/057090, dated Mar. 3, 2011.
"Control of Hazardous Air Pollutants From Mobile Sources", U.S. Environmental Protection Agency. Mar. 29, 2006. p. 15853 (http://www.epa.gov/EPA-AIR/2006/March/Day-29/a2315b.htm).
Von Hippel, Arthur R., Dielectrics and Waves, Copyright 1954, Library of Congress Catalog Card No. 54-11020, Contents, pp. xi-xii; Chapter II, Section 17, "Polyatomic Molecules", pp. 150-155; Appendix C-E, pp. 273-277, New York, John Wiley and Sons.

* cited by examiner

IN SITU LOOP ANTENNA ARRAYS FOR SUBSURFACE HYDROCARBON HEATING

STATEMENT REGARDING FEDERALLY SPONSORED RESEARCH OR DEVELOPMENT

[Not Applicable]

CROSS REFERENCE TO RELATED APPLICATIONS

This specification is related to Ser. Nos. 12/395,995; 12/395,945; 12/396,192; 12/396,021; 12/396,284; 12/396,057; 12/395,953; and 12/395,918 filed on or about the same date as this specification, each of which is incorporated by reference here.

BACKGROUND OF THE INVENTION

The invention concerns heating of hydrocarbon materials in geological subsurface formations by radio frequency electromagnetic waves (RF), and more particularly to heating by RF energy emitted from one or more polygonal antennas.

Extraction from heavy oil reservoirs including oil sands deposits, shale deposits and carbonate deposits, requires heating of the deposits to separate hydrocarbons from other geologic materials and to maintain hydrocarbons at temperatures at which they will flow. Known methods of heating such deposits include steam heating, electric resistance heating and heating by RF energy.

Heating subsurface heavy oil bearing formations by prior RF systems has been inefficient due to traditional methods of matching the impedances of the power source (transmitter) and the heterogeneous material being heated, uneven heating resulting in unacceptable thermal gradients in heated material, inefficient spacing of electrodes/antennae, poor electrical coupling to the heated material, limited penetration of material to be heated by energy emitted by prior antennae and frequency of emissions due to antenna forms and frequencies used. Antennas used for prior RF heating of heavy oil in subsurface formations have typically been dipole antennas. U.S. Pat. Nos. 4,140,179 and 4,508,168 disclose prior dipole antennas positioned within subsurface heavy oil deposits to heat those deposits.

Arrays of dipole antennas have been used to heat subsurface formations. U.S. Pat. No. 4,196,329 discloses an array of dipole antennas that are driven out of phase to heat a subsurface formation.

SUMMARY OF THE INVENTION

An aspect of the invention concerns an array of loop antennas for a heating subsurface formation comprising a first loop antenna that is positioned within a subsurface formation, lies approximately within a first plane and generally forms an arc of radius r, and a second loop antenna positioned within the subsurface formation adjacent to the first antenna and generally forming a second arc of radius r and lying approximately within a second plane that is parallel to the first plane and separated from the first plane by the distance r.

Another aspect of the invention concerns a method of heating a subsurface formation comprising positioning within the subsurface formation a first loop antenna that lies generally along a first arc of radius r and is generally within a first plane, positioning within the subsurface formation a second loop antenna that lies generally along a second arc of radius r and is generally within a second plane that is approximately parallel to and separated from the first plane by the distance r, and providing RF energy of equal frequency, amplitude and phase to the first and second antennas.

Another aspect of the invention concerns a loop antenna approximating a helix to form an array of loop antennas for heating a subsurface formation. The antenna forms a first loop that is positioned within the subsurface formation, lies approximately within a first plane and is formed by a first plurality of connected segments of the antenna that extend from a first location to a second location. The antenna also forms a second loop that is positioned within the subsurface formation, that lies approximately within a second plane, is separated from the first loop and is formed by a second plurality of connected segments of the antenna extending from a third location to a fourth location. A segment of the antenna extends from the second location to the third location.

DETAILED DESCRIPTION OF THE PREFERRED EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are examples of the invention, which has the full scope indicated by the language of the claims. Like numbers refer to like elements throughout.

Figure 1:
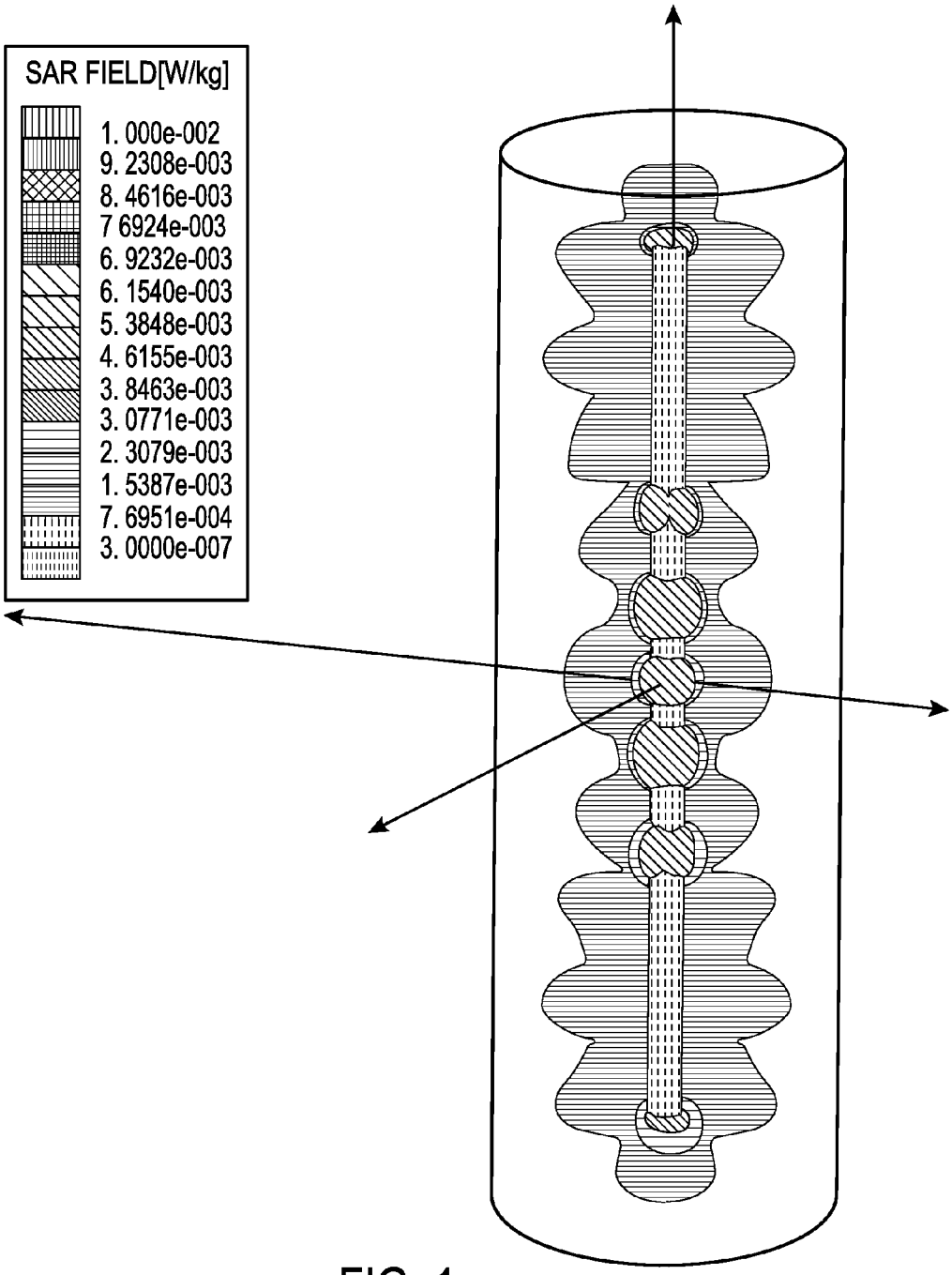
FIG. 1 (PRIOR ART)
FIG. 1 is an illustration of simulated heating of a subsurface formation by a dipole antenna.

Subsurface formations are heated by RF emission from antennas that are positioned within and therefore are surrounded by the material to be heated. Subsurface material is heated primarily in the reactive near field region of embedded antennas. Heating of subsurface material by dipole antennas is therefore primarily effected by dielectric heating by near field electric (E) field. As illustrated by FIG. 1, heating of homogeneous material adjacent to a dipole antenna, as evaluated by specific absorption rate, varies significantly along the length of the antenna. Intense heating of material near an antenna is undesirable because intense heating of small areas is not an efficient use of energy and is also undesirable because overheating of subsurface formations can create material that is impermeable and prevent or impede extraction of hydrocarbon material.

Figure 2:
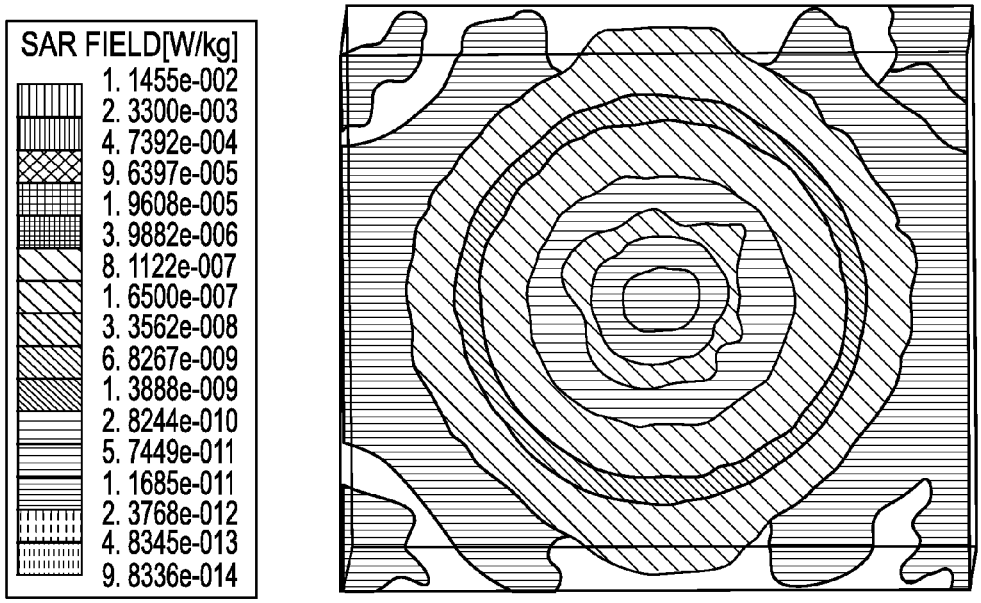
FIG. 2 is an illustration of simulated heating of a subsurface formation by a loop antenna.

RF fields emitted by loop antennas differ from the fields emitted by dipole antennas in the near field region. The curl of a loop antenna creates near field magnetic fields. A loop antenna may be approximated by a polygon. The greater the number of sides of the polygon, the closer the approximation of the curl of a curved loop antenna. As shown by FIG. 2, the near field created by a loop antenna heats homogeneous material that surrounds the antenna much more uniformly than do dipole antennas. Loop antennas are particularly advantageous for heating materials in which eddy currents are created by magnetic fields. Water is one such material.

Hydrocarbons that must be heated to be extracted from subsurface formations, including oil sands deposits, shale deposits and carbonate deposits, are generally mixed with other materials including water. There other materials make heating by RF emissions feasible as hydrocarbons are generally heated poorly by RF emissions. Applying RF emissions to subsurface hydrocarbon formations generally heats material other than the hydrocarbons and these heated materials heat the hydrocarbons by heat conduction. Hydrocarbons deposits, particularly oil sands deposits typically contain water. Water is conductive and therefore susceptible to heating by magnetic fields. Loop antennas are therefore desirable for heating these deposits within the antenna near field.

Heating of subsurface formations by RF magnetic fields can be increased by injection of an RF susceptor. Sodium hydroxide lye increases the conductivity of the in situ water and thereby increases the flow of eddy electrical currents that are induced by RF magnetic fields.

Figure 3:
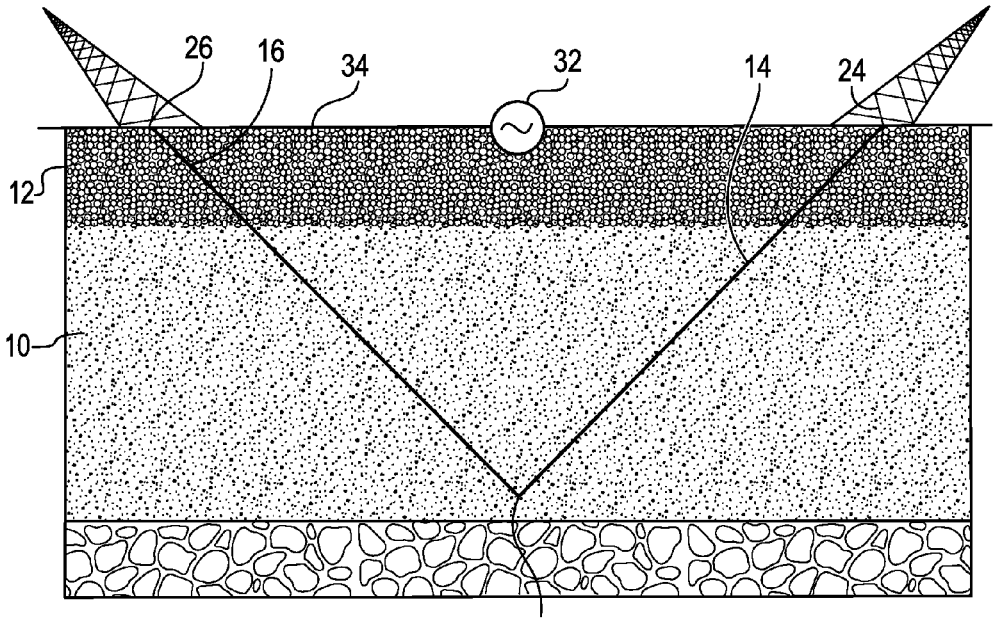
FIG. 3 illustrates heating of an oil sands formation by an polygonal loop antenna according to the present invention.

FIG. 3 illustrates heating of an oil sands deposit by a loop antenna according to the present invention. As shown by FIG. 3, an oil sands formation 10 is beneath a covering overburden region 12. Two boreholes, 14 and 16 are drilled from separated locations 24 and 26 on the surface of the overburden 12. The boreholes 14 and 16 extend from the locations 24 and 26, respectively, toward each other to meet at location 28 within the oil sands formation 10. A loop antenna 34 extends from an RF transmitter 32 on the surface of overburden 12. The loop antenna 34 extends from the transmitter 32 to the openings of the boreholes 14 and 16 at locations 24 and 26 on the surface of the overburden 12, and through the boreholes 14 and 16. The loop antenna 34 is only partially positioned within the oil sands formation 10.

Figure 4:
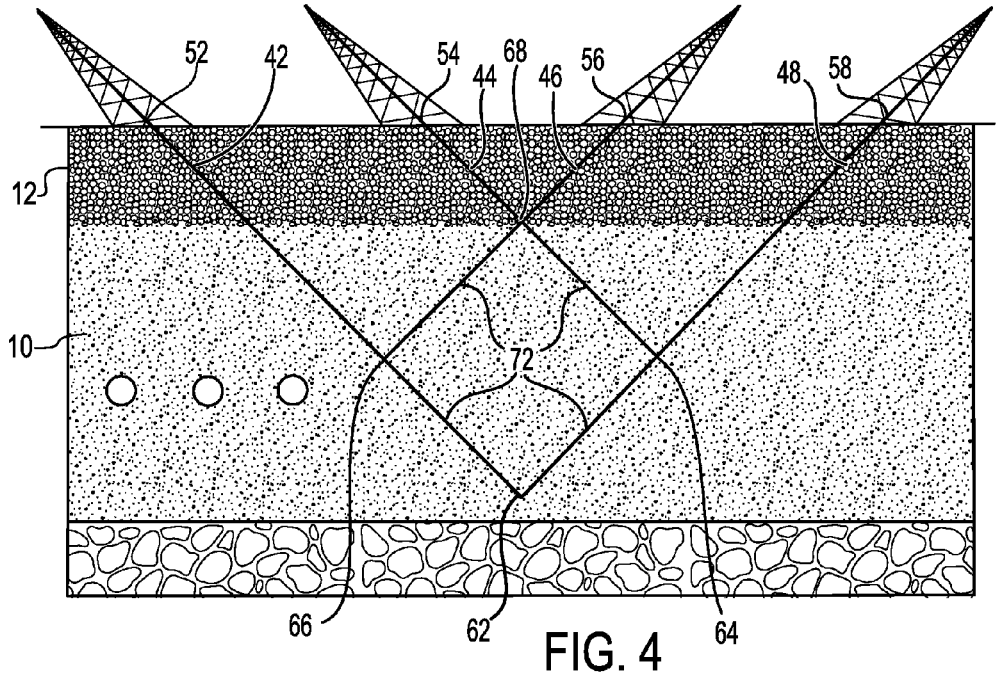
FIG. 4 illustrates formation of linked boreholes forming a four sided polygon to accept a loop antenna according to the present invention.

FIG. 4 illustrates four boreholes, 42, 44, 46 and 48, that are drilled into the oil sands formation 10. The boreholes 42 and 48 are drilled from separated locations 52 and 58, respectively, on the surface of the overburden 12. The boreholes 42 and 48 extend from the locations 52 and 58, respectively, toward each other to meet at location 62 within the oil sands formation 10. The boreholes 44 and 46 are drilled from separated locations 54 and 56, respectively, on the surface of the overburden 12. The boreholes 44 and 46 extend from locations 54 and 56, respectively, on the surface of overburden 12. Locations 54 and 56 are on a line extending from location 52 to location 58 and are between locations 52 and 58. Location 54 is adjacent to and separated from location 52 and location 56 is adjacent to and separated from location 58. The borehole 44 extends from location 54 generally parallel to borehole 42 to intersect borehole 48 at location 64 which is within the oil sands formation 10 between location 62 and location 58. The borehole 46 extends from location 56 generally parallel to borehole 48 to intersect borehole 42 at location 66 which is within the oil sands formation 10 between location 62 and location 52. As shown by FIG. 4, the boreholes 44 and 46 intersect each other at location 68 which is near the interface of the overburden 12 and the oil sands formation 10. The borehole 46 extends from the location 68 to the location 66 and the borehole 44 extends from the location 68 to the location 64. The sections of boreholes 42, 48, 44 and 46 extending from location 66 to 62, location 62 to location 64, location 64 to location 68 and location 68 to location 66, respectively, form four connected borehole segments that form a four side polygon 72 within the oil sands formation 10. The polygon 72 lies generally within a plane.

Figure 5:
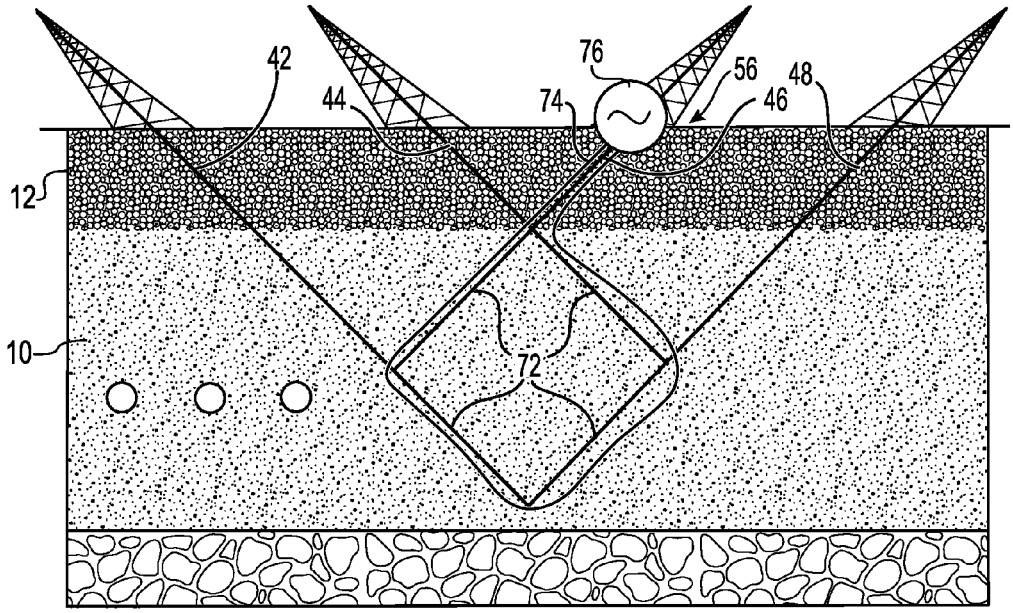
FIG. 5 illustrates an antenna according to the present invention in the boreholes illustrated by FIG. 4.

FIG. 5 schematically illustrates an antenna 74 extending to the four sided polygon 72 through the borehole 46. The antenna 74 forms a loop within the borehole polygon 72. A transmitter 76, shown at location 56, is connected to antenna 74 to provide an RF signal to the antenna 74.

Figure 6:
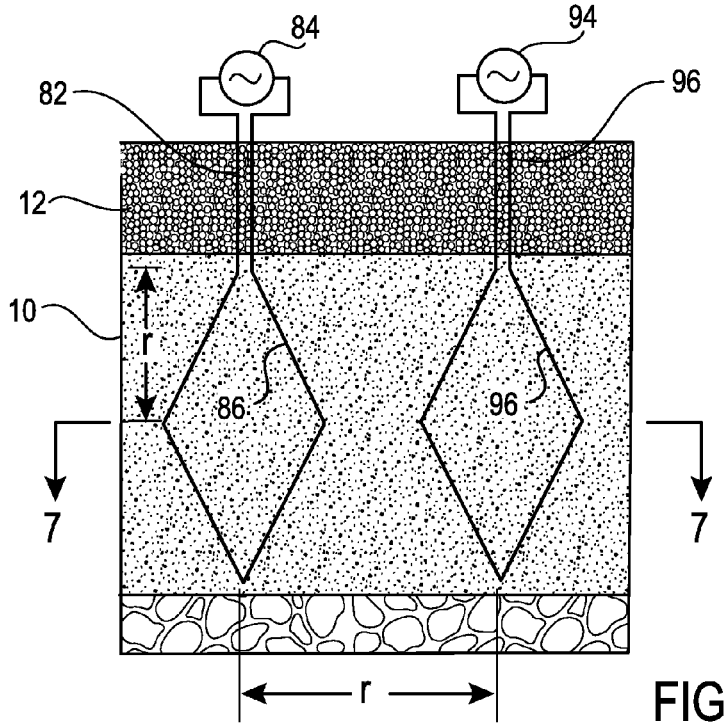
FIG. 6 is an isometric view of an array of subsurface polygonal loop antennas according to the present invention.

FIG. 6 illustrates two antennas, 82 and 92, arranged in an array within an oil sands formation 10. The antennas 82 and 92 each form a four sided polygon loop, 86 and 96 respectively, that lie generally parallel to each other within the oil sands formation 10. The loops 86 and 96, shown in an isometric view by FIG. 6, are preferably formed to approximate a loop at a distance r from a center of the polygon. The polygon loops 86 and 96 are not uniformly at the distance r from the center. They may nevertheless be generally characterized by the distance r that approximates the radius of a loop along which the polygons 86 and 96 lie. As shown by FIG. 6, the antennas 82 and 92 are separated by that distance r. The transmitters 84 and 94 drive the antennas 82 and 92, respectively, each providing RF energy to their attached antennas at equal frequency, amplitude and phase.

Figure 7:
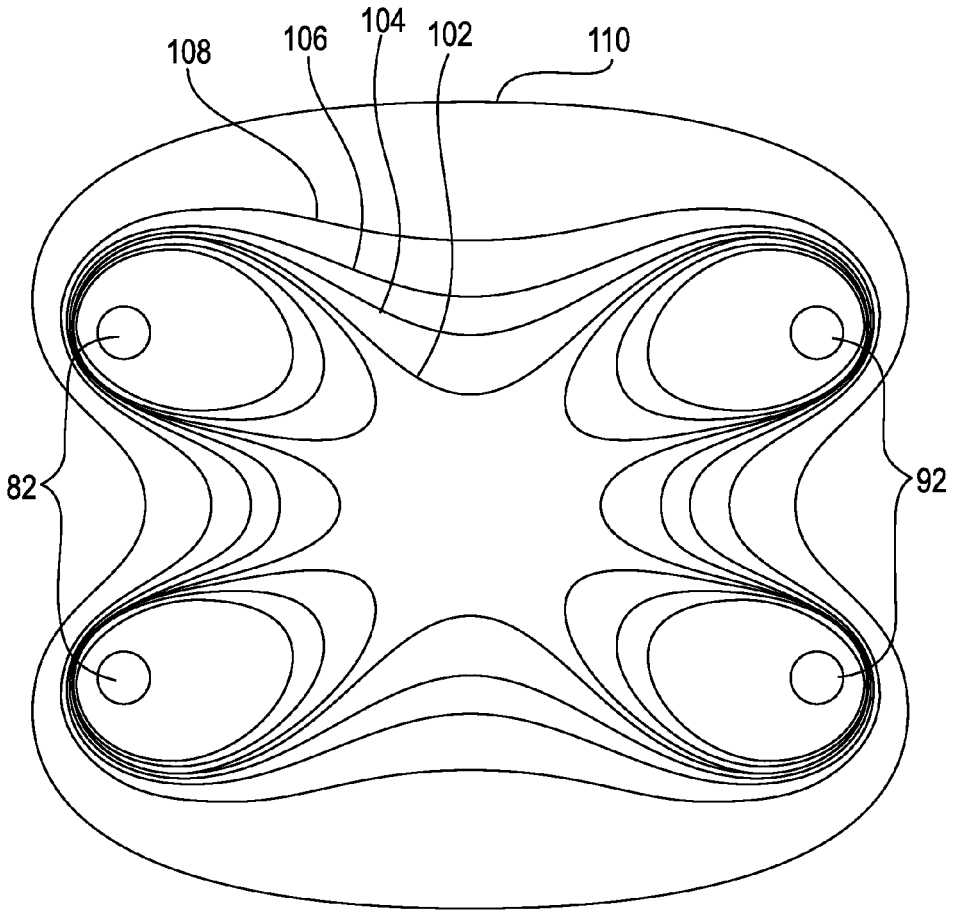
FIG. 7 illustrates the magnetic near field created by the array of polygonal loop antennas shown by FIG. 6.

By positioning the antennas 82 and 92 in the positions with respect to each other as illustrated by FIG. 6, the near magnetic fields created by the antennas overlap each other to create a zone of approximately constant heating. FIG. 7 illustrates the magnetic fields created by the antennas 82 and 92 in the plane 7 as indicated in FIG. 6. Cross sections of antennas 82 and 92 are shown on FIG. 7. Contours 102, 104, 106, 108 and 110 are at the edges of regions of uniform heating due to near fields of antennas 82 and 92. The near fields created by antennas 82 and 92 in the relative positions shown by FIGS. 6 and 7 overlap each other to create the illustrated large heated region of material surrounding the antennas 82 and 92.

Figure 8:
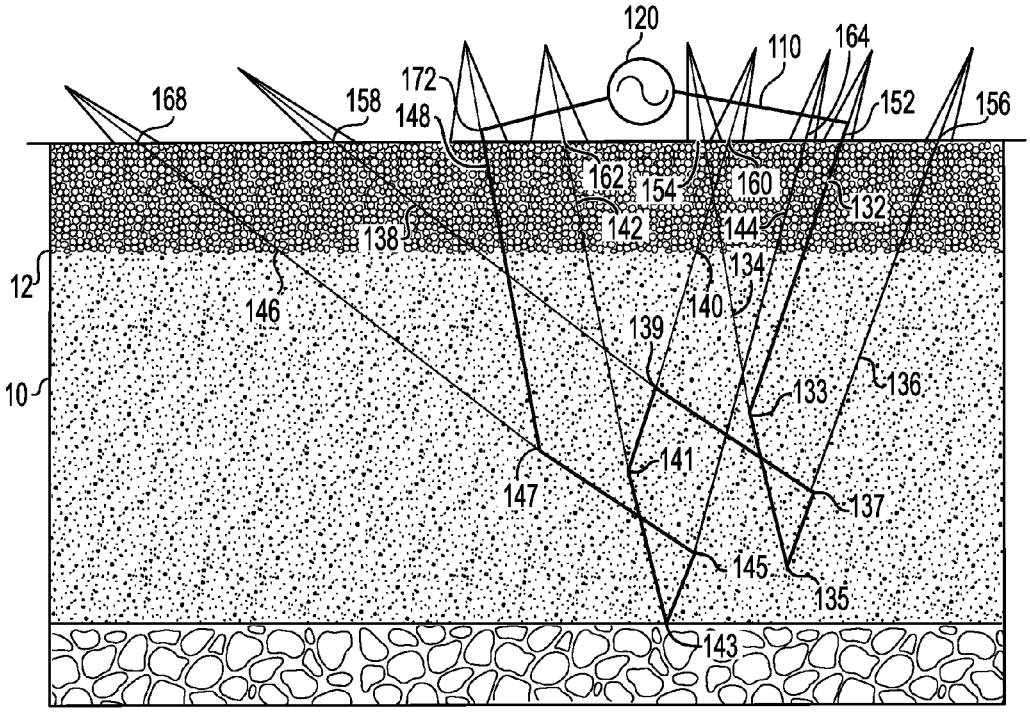
FIG. 8 is an isometric view of a subsurface antenna according to the present invention that approximates a helix by a series of partial loops.

FIG. 8 shows an antenna 110 positioned within an oil sands formation 10. RF energy is provided to the antenna 110 by a transmitter 120. The antenna 110 approximates a helical configuration in the oil sands formation 10 by extending through sections of intersecting boreholes. A borehole 132 extends though the overburden 12 from location 152 on the surface of the overburden 12 and into the oil sands formation 10 to a location 133. A borehole 134 extends into the overburden 12 and oil sands formation 10 from a location 154 on the surface of the overburden 12 that is separated from the location 152. The borehole 134 extends to intersect the borehole 132 at location 133 and extends beyond location 133 into the oil sands formation 10 to a location 135. A borehole 136 extends into the overburden 12 and oil sands formation 10 from a location 156 on the surface of the overburden 12 that is separated from the location 152. The borehole 136 extends generally parallel to the borehole 132 to intersect the borehole 134 at location 135. The boreholes 132, 134 and 136 lie in a first plane. A borehole 138 extends into the overburden 12 and oil sands formation 10 from a location 158 on the surface of the overburden 12 that is separated from the locations 152, 154 and 156. The borehole 138 extends to intersect the borehole 136 at a location 137 that is within the oil sands formation 10 and that is between the locations 135 and 156. The borehole 138 extends from the first plane in which the boreholes 132, 134 and 136 lie.

A borehole 140 extends into the overburden 12 and oil sands formation 10 from a location 160 on the surface of the overburden 12 that is separated from the location 152. The borehole 140 extends generally parallel to borehole 132 to intersect the borehole 138 at a location 139 that is within the oil sands formation 10 The borehole 140 extends beyond the location 139 to a location 141 that is deeper in the oil sands formation 10. A borehole 142 extends into the overburden 12 and oil sands formation 10 from a location 162 on the surface of the overburden 12 that is separated from the location 154. The borehole 142 extends generally parallel to borehole 134 to intersect the borehole 140 at the location 141. The borehole 142 extends beyond the location 141 to a location 143 that is deeper in the oil sands formation 10. A borehole 144 extends into the overburden 12 and oil sands formation 10 from a location 164 on the surface of the overburden 12 that is separated from the locations 160 and 156. The borehole 144 extends generally parallel to borehole 140 to intersect the borehole 142 at the location 143. The boreholes 140, 142 and 144 lie in a second plane. A borehole 146 extends into the overburden 12 and oil sands formation 10 from a location 168 on the surface of the overburden 12 that is separated from the locations 160, 162 and 164. The borehole 146 is generally parallel to the borehole 138 and extends to intersect the borehole 144 at a location 145 that is within the oil sands formation 10 and is between the locations 143 and 164. The borehole 146 extends from the second plane in which the boreholes 140, 142 and 144 lie. A borehole 148 extends into the overburden 12 and the oil sands formation 10 from a location 172 on the surface of the overburden 12 that is separated from the location 162. The borehole 148 intersects the borehole 146 at a location 147 that is within the oil sands formation 10 and between the location 145 and the location 168.

The antenna 110 approximates a helix by a series of connected segments that extend within the intersecting boreholes. A first segment of the antenna 110 extends into the oil sands formation 10 through the borehole 132 to the location 133. A second segment extends from the location 133 through the borehole 134 to the location 135. A third segment of the antenna 110 extends from the location 135 through the borehole 136 to the location 137. A fourth segment extends from the location 137 through the borehole 138 to the location 139. A fifth segment of the antenna 110 extends from the location 139 through the borehole 140 to the location 141. A sixth segment extends from the location 141 through the borehole 142 to the location 143. A seventh segment of the antenna 110 extends from the location 143 through the borehole 144 to the location 145. An eighth segment of the antenna 110 extends from the location 145 through the borehole 146 to the location 147. A ninth segment of the antenna 110 extends from the location 147 to the surface of the overburden 12 through borehole 148.

The antenna 110 forms an array of partial loop antennas, each partial loop formed by three connected segments extending through boreholes. Partial loops are formed by borehole 132, 134 and 136, boreholes 134, 136 and 138, boreholes 136, 138 and 140, boreholes 138, 140 and 142, boreholes 140, 142 and 144 and boreholes 142, 144 and 146. The partial loop formed by the first, second and third segments in boreholes 132, 134 and 136 lies in the first plane and the partial loop formed by the fifth, sixth and seventh segments in boreholes 140, 142 and 144 lies in the second plane. The series of partial loops formed by the segments of antenna 110 in boreholes 132, 134, 136, 138, 140, 142, 144 and 146 approximate a helix through the oil sands formation 10.

Figure 9:
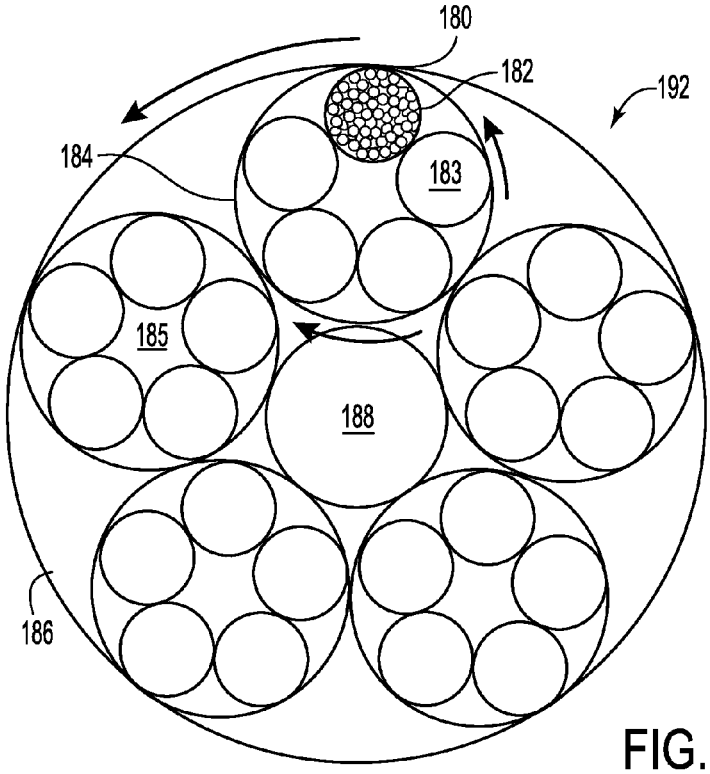
FIG. 9 illustrates a cross section of an antenna according to the present invention formed by Litz conductors.

Antennas according to the present invention emit RF energy to heat surrounding subsurface material in the near field region of the antenna. As described by the inventor's U.S. Pat. No. 7,205,947, the entirety of which is incorporated herein by reference, RF current tends to flow along the surface of conductors in an effect that is referred to as a skin effect. This effect limits the useful amount of a conductor's cross section for carrying RF energy. Because antennas according to the present invention are intended to emit significant energy, this skin effect is particularly undesirable in antennas according to the present invention. As described by the applicant's U.S. patent, Litz wires can be used to reduce the undesirable skin effect in an antenna. As shown by the cross section of a Litz wire 192 illustrated by FIG. 9, a Litz wire is formed by a plurality of wires 180 that are braided together. The plurality of wires 180 are preferably individually insulated wires with an outer insulation 182 to form an insulated bundle 183. Dielectric strands may be included with the plurality of wires 180. Groups 185 of insulated bundles 183 may be braided or twisted together and include an outer insulation 184. The groups 185 may also be braided or twisted together to define the Litz wire antenna loop with a further outer insulation 186. The groups 185 may be braided or twisted about a core 138 made of dielectric material.

I claim:

1. An array of loop antennas for heating a subsurface formation comprising:

a first loop antenna positioned within the subsurface formation, the first loop antenna configured as a polygonal loop and lying approximately within a first plane, with the polygonal loop having a center and a plurality of vertices so that a distance therebetween is r;

a first RF source above the subsurface formation and configured to provide RF energy to said first loop antenna;

a second loop antenna positioned within the subsurface formation, the second loop antenna configured as a polygonal loop that is separate from and not connected to the first antenna and lying approximately within a second plane, with the polygonal loop having a center and a plurality of vertices so that a distance therebetween is r, with the second plane being generally parallel to the first plane and separated from the first plane by the distance r; and a second RF source above the subsurface formation and configured to provide RF energy to said second loop antenna.

2. The array of loop antennas of claim 1 wherein the first loop antenna and the second loop antenna are each formed by a series of connected generally straight segments.

3. The array of loop antennas of claim 1 wherein the first loop antenna and the second loop antenna are each formed by a series of connected generally straight segments that form the polygon loop.

4. The array of loop antennas of claim 3 wherein the polygonal loops of the first and second loop antennas each form a four side polygon.

5. The array of loop antennas of claim 1 wherein the first loop antenna and the second loop antenna are each formed by Litz wire.

6. A method of heating a subsurface formation comprising:

positioning a first loop antenna within the subsurface formation to lie generally within a first plane, the first loop antenna configured as a polygonal loop and having a center and a plurality of vertices so that a distance therebetween is r;

operating a first RF source to provide RF energy to the first loop antenna;

positioning a second loop antenna within the subsurface formation to lie generally within a second plane that is separate from and not connected to the first antenna, the second plane generally parallel to and separated from the first plane by the distance r and the second loop antenna configured as a polygonal loop and having a center and a plurality of vertices so that a distance therebetween is r; and operating a second RF source to provide RF energy to the second loop antenna.

7. The method of heating a subsurface formation of claim 6 further comprising introducing a susceptor into the formation that increases the conductivity of material in the formation.

8. The method of heating a subsurface formation of claim 7 wherein the susceptor includes sodium hydroxide.

9. The method of heating a subsurface formation of claim 6 wherein the first and second loop antennas are each formed by a series of connected generally straight segments.

10. The method of heating a subsurface formation of claim 6 wherein the first loop antenna and the second loop antenna are each formed by a series of connected generally straight segments that form the polygon loop polygon.

* * * * *